US007119484B2

(12) United States Patent
Damm et al.

(10) Patent No.: US 7,119,484 B2
(45) Date of Patent: Oct. 10, 2006

(54) HEADLAMP CAPSULE WITH DEBRIS PROTECTION

(75) Inventors: Matthias Damm, Gaimersheim (DE); Roland Stark, Wellheim (DE); Marcel Vuc, Neuburg (DE)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 105 days.

(21) Appl. No.: 10/732,342

(22) Filed: Dec. 11, 2003

(65) Prior Publication Data

US 2004/0120145 A1 Jun. 24, 2004

(30) Foreign Application Priority Data

Dec. 19, 2002 (DE) ..... 102 60 125

(51) Int. Cl.
*H01J 5/48* (2006.01)

(52) U.S. Cl. ..... 313/318.01

(58) Field of Classification Search ..... 313/318.01, 313/318.05, 318.09–318.11
See application file for complete search history.

(56) References Cited

U.S. PATENT DOCUMENTS 3,602,759 A 8/1971 Evans
3,789,212 A 1/1974 Wagner
4,219,870 A * 8/1980 Haraden et al. ..... 362/659
4,376,967 A 3/1983 Hough
4,392,189 A 7/1983 Hough
4,403,276 A 9/1983 Blaisdell
4,945,288 A * 7/1990 Morris et al. ..... 313/25
5,206,558 A 4/1993 Losonczi
5,278,744 A 1/1994 Geboers
5,726,532 A 3/1998 Wittig
6,692,308 B1 * 2/2004 Henrici et al. ..... 439/699.2

FOREIGN PATENT DOCUMENTS

DE 299 05 836 9/1999
EP 0487 142 5/1992

* cited by examiner

*Primary Examiner*—Joseph Williams
(74) *Attorney, Agent, or Firm*—William E. Meyer

(57) ABSTRACT

The invention relates to an illumination unit having an electric lamp and an envelope fixed thereto, the lamp having a base, in particular a G9 base, protruding from said envelope, and the fastening means for the envelope being connected to the lamp vessel such that the base is freely accessible for a corresponding lamp holder.

12 Claims, 7 Drawing Sheets

HEADLAMP CAPSULE WITH DEBRIS PROTECTION

I. TECHNICAL FIELD

Figure 1:
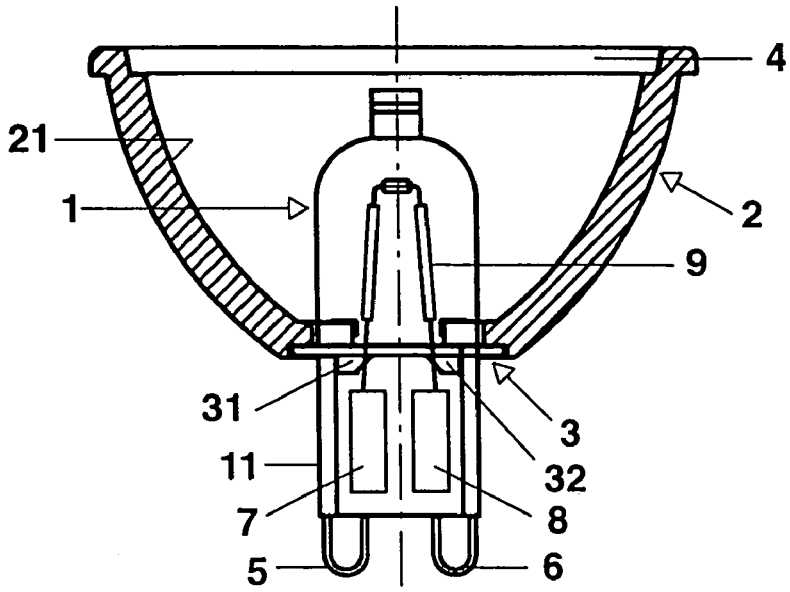

The invention relates to an illumination unit comprising an electric lamp which has a lamp vessel having a sealed-off end, an envelope which is fixed to the lamp, which at least partially surrounds the lamp vessel (10) and which has an aperture, and comprising fastening means for fastening the envelope to the lamp.

II. BACKGROUND ART

An illumination unit of this type has been disclosed, for example, in German utility model DE 299 05 836. This publication describes an illumination unit comprising a reflector, an incandescent lamp arranged therein and a reflector neck insert comprising two halves which surrounds the sealed-off end of the lamp vessel and is fixed in the conically formed reflector neck with a clamping fit. The sealed-off end of the lamp vessel has two webs which respectively engage in grooves which are provided on each half of the reflector neck insert.

III. DISCLOSURE OF THE INVENTION

The object of the present invention is to propose an illumination unit, having an electric lamp and an envelope, which has improved fastening means for fastening the envelope and the lamp. In particular, the fastening means should be configured such that the illumination unit does not require its own base or adapter, but that rather the lamp base is freely accessible and the illumination unit can be inserted into a lamp holder which is matched to the lamp base.

This object is achieved by an illumination unit comprising an electric lamp which has a lamp vessel having a sealed-off end, an envelope which is fixed to the lamp, which at least partially surrounds the lamp vessel and which has an aperture for the lamp, and comprising fastening means for fastening said envelope to the lamp, wherein the sealed-off end of said lamp vessel is in the form of a base, from the end of which the electrical contacts of the lamp protrude, said base protrudes from the envelope through said aperture, and the fastening means are connected to the lamp vessel. Particularly advantageous refinements of the invention are described in the dependent patent claims.

The illumination unit according to the invention has an electric lamp having a sealed-off end in the form of a base and an envelope which at least partially surrounds the lamp vessel and is fastened to the lamp vessel such that the base protrudes from the envelope through an aperture. These measures mean that the lamp base is freely accessible and can be inserted in a corresponding lamp holder. This makes it possible for the illumination unit according to the invention to be used in the corresponding luminaires instead of simply the lamp. The envelope is preferably a reflector, for example a so-called cold-light mirror, which is permeable to infrared radiation, or a transparent outer bulb.

In a particularly advantageous manner, the invention can therefore be applied to high-voltage halogen incandescent lamps which are provided with a glass base, in particular a G9 base, have comparatively small dimensions and can be operated, without using voltage transformers, directly from the AC mains voltage. In order to ensure that, in the case of illumination units according to the invention which are provided with these lamps, there is good electrical contact with the lamp holder and that the unit is held securely in the lamp holder, the minimum spacing between the envelope and the end of the base, from which the electrical contacts of the lamp protrude, is at least 12 mm. These illumination units have markedly smaller dimensions than the conventional high-voltage reflector lamps. The use of a glass base also offers the advantage that it is formed directly from the material of the lamp vessel and can thus be matched to the fastening means for the envelope in a simple manner whilst sealing the lamp vessel.

In order to ensure that the envelope is fitted to the lamp vessel in as simple a manner as possible, a clip is advantageously used as the fastening means. The spring action of a clip allows for a reliable, purely mechanical fastening of the envelope to the lamp vessel. In particular, a clamping fit between the lamp vessel and the envelope can be produced in a simple manner by means of a clip. The clip is advantageously made of sheet metal in order to be able to make use of the material properties of the sheet metal to achieve the spring action for the clip. In addition, the clip may as a result be designed as a punched sheet-metal part which is simple to produce. Furthermore, the clip has a small extent in the longitudinal direction of the illumination unit such that the base is hardly covered by the abovementioned fastening means.

The envelope can be fastened to the lamp in a particularly simple and favorable manner by the clip being supported on first support surfaces of the lamp vessel which are formed from the material of the lamp vessel, by the envelope resting on second support surfaces of the lamp vessel which are formed from the material of the lamp vessel, and by the clip bearing against the envelope such that the spring action of the clip presses the envelope against the second support surfaces. The envelope is thereby held on the lamp vessel in a clamping manner between the clip and the second support surfaces, the clip being supported on the first support surfaces which act as opposing bearings to the second support surfaces. Or, in other words, the envelope and the clip are arranged with a clamping fit between the first and second support surfaces of the lamp vessel, the clamping fit being achieved by the spring action of the clip. The abovementioned support surfaces are advantageously in the form of moldings on the lamp vessel which can be produced in a simple manner whilst forming the lamp vessel. These moldings cause depressions in the surface of the lamp vessel which are suitable as support surfaces and also as notches for latching connections.

The spring action of the clip is advantageously realized by means of at least two resiliently formed tabs which are integrally formed on the clip and are supported on the first support surfaces of the lamp vessel.

The envelope can be fastened to the lamp in an alternative, likewise favorable manner by the clip being connected to the lamp vessel by a first latching connection and to the envelope by a second latching connection. The first latching connection is advantageously formed by means of at least two resiliently formed first tabs which are integrally formed on the clip and are supported on support surfaces of the lamp vessel which are formed from the material of the lamp vessel, a region of the lamp vessel which is adjacent to the base and is wider than the base acting as the opposing bearing for the clip.

In this manner, the specific geometry of the lamp vessel is advantageously used for fastening the clip to the lamp. The second latching connection is advantageously formed by means of at least two resiliently formed second tabs which are integrally formed on the clip and protrude through the aperture in the envelope and are latched behind on the rim of the aperture. With the aid of these latching connections realized in this manner, the envelope is fastened to the lamp vessel, namely in the transition region from the base to the wider part of the lamp vessel which surrounds the luminous element. This ensures that the base is not covered by the envelope or the fastening means and is available for insertion into a lamp holder. However, instead of by means of the second tabs, the clip may also be fixed to the envelope using bonding agent.

In accordance with a further preferred embodiment, the clip has at least two resiliently formed third tabs which are supported on the region of the lamp vessel which is adjacent to the base and is wider than the base. The interaction of the third tabs with the abovementioned first tabs fixes the clip to the lamp vessel in a clamping manner in the longitudinal direction of the lamp.

Alternatively, a fastening ring, for example of ceramic, may also be used as the fastening means for the envelope on the lamp vessel and is fixed to the envelope and the lamp vessel using bonding agent.

IV. BRIEF DESCRIPTION OF THE DRAWINGS

Figure 2:
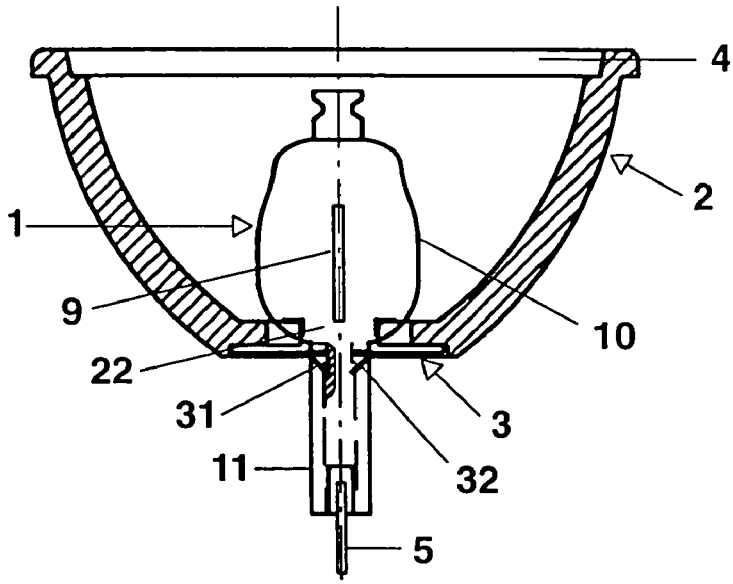
Figure 3:
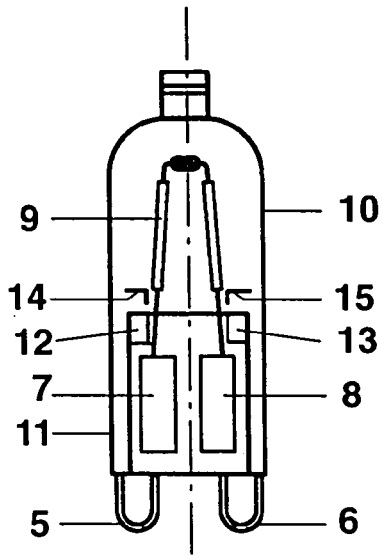
Figure 4:
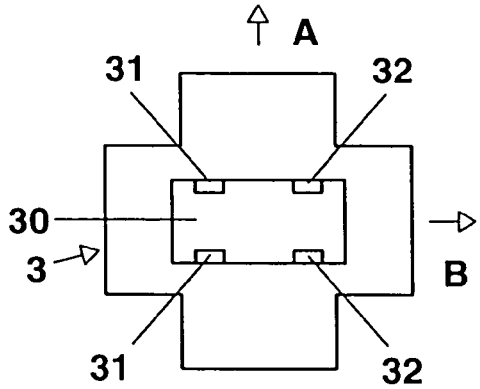
Figure 5:
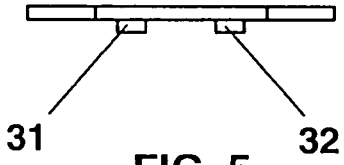
Figure 6:
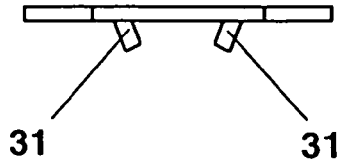
Figure 7:
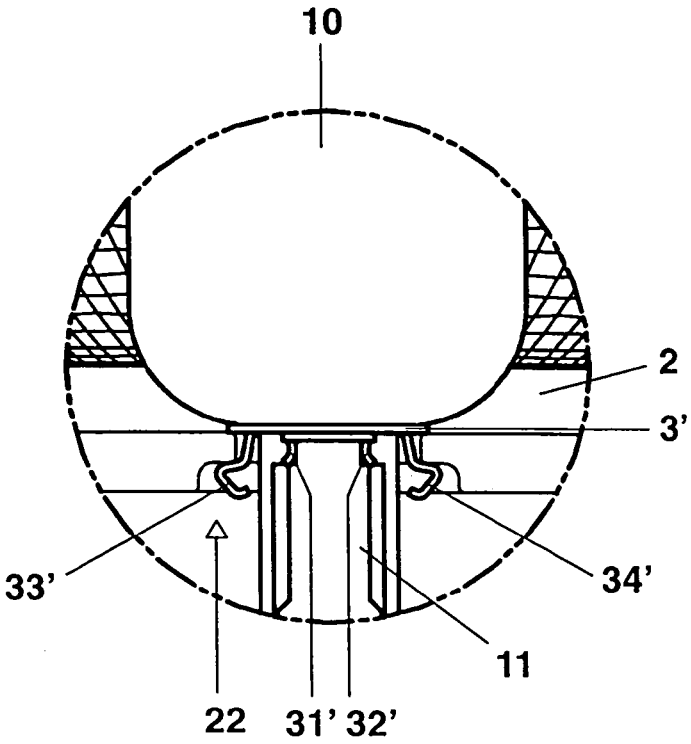
Figure 8:
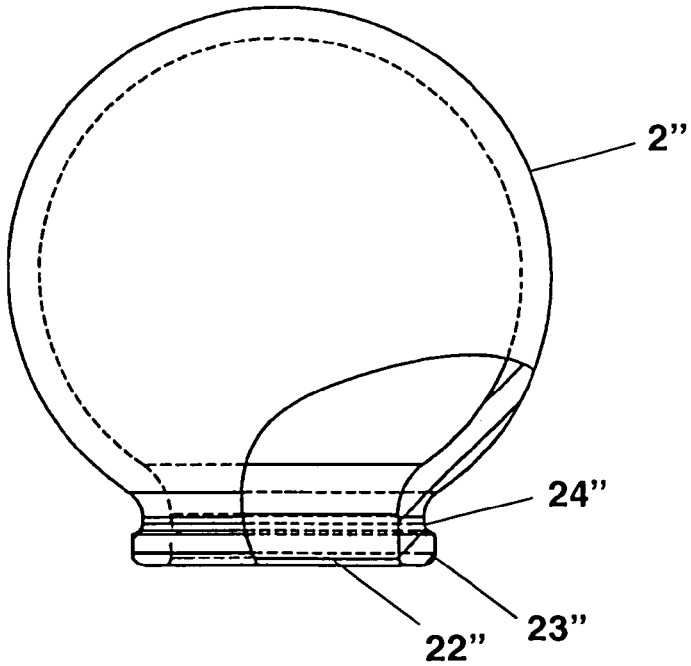
Figure 9:
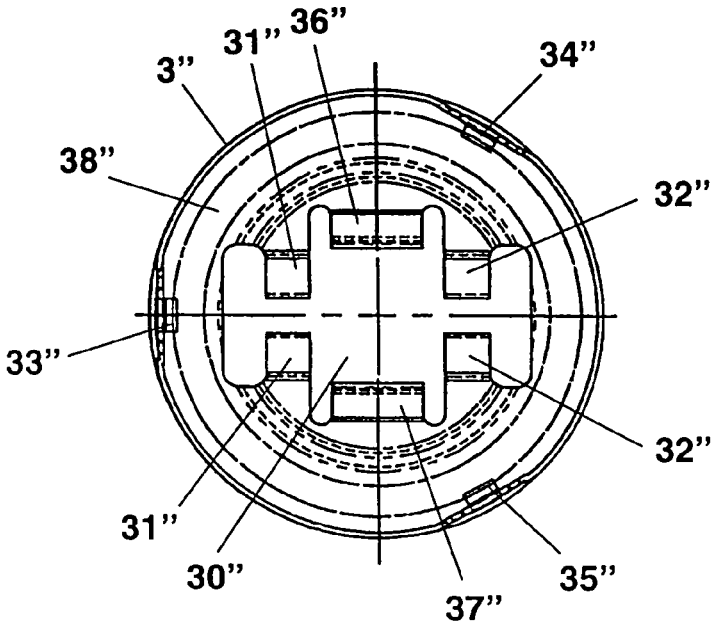
Figure 10:
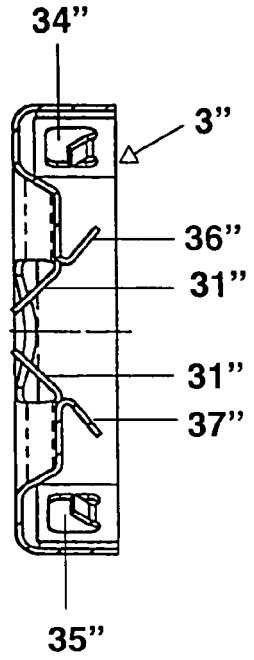
Figure 11:
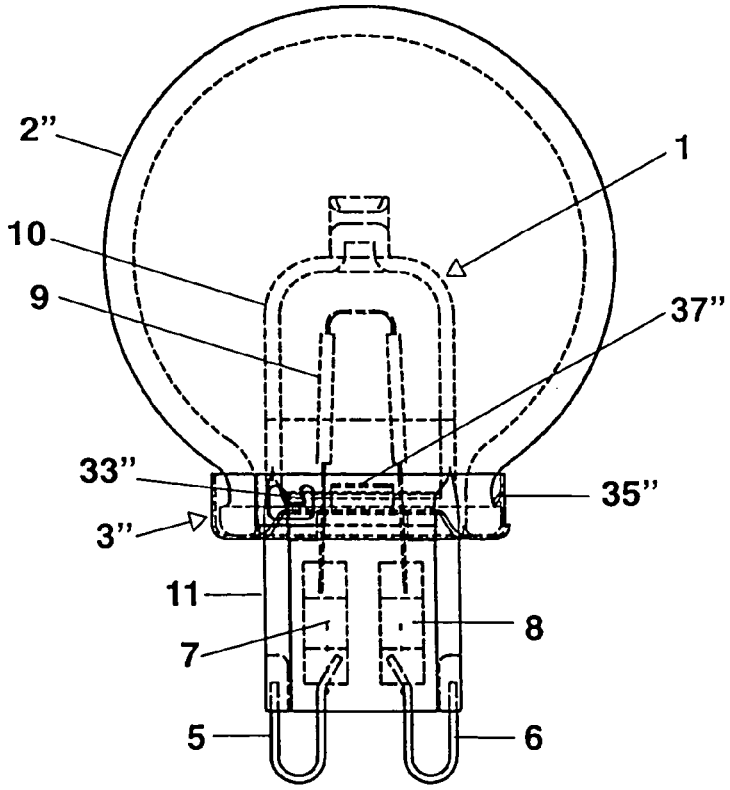
Figure 12:
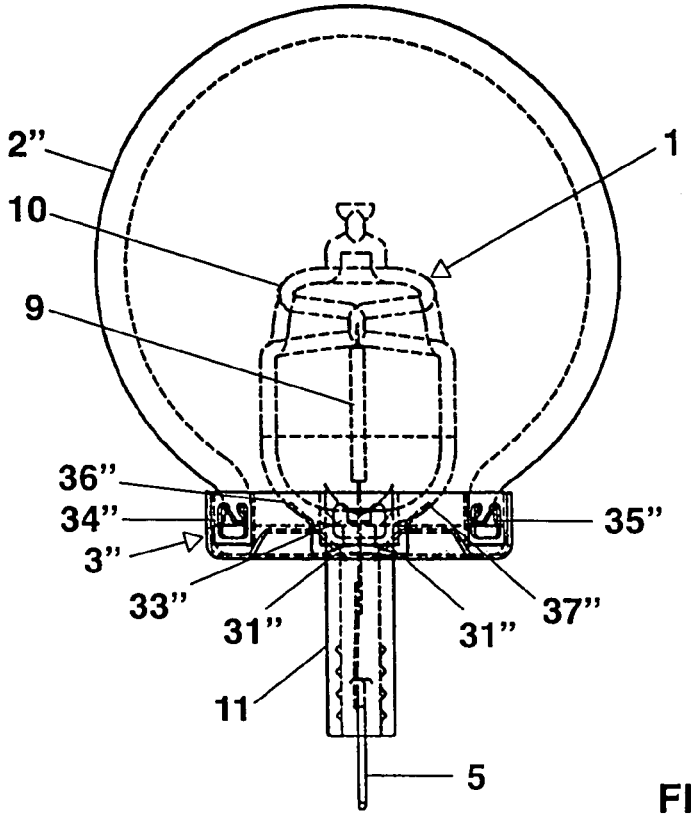
Figure 13:
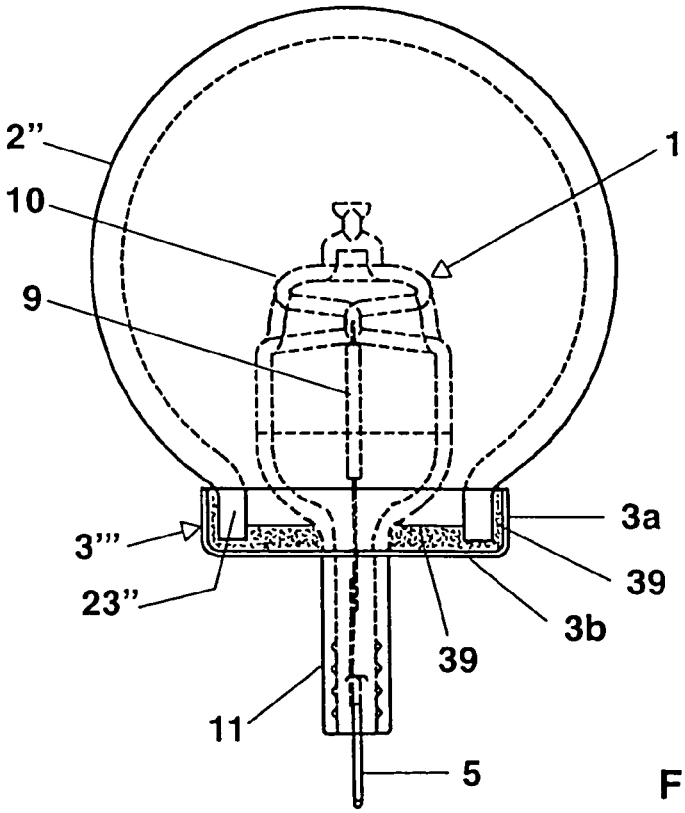
Figure 14:
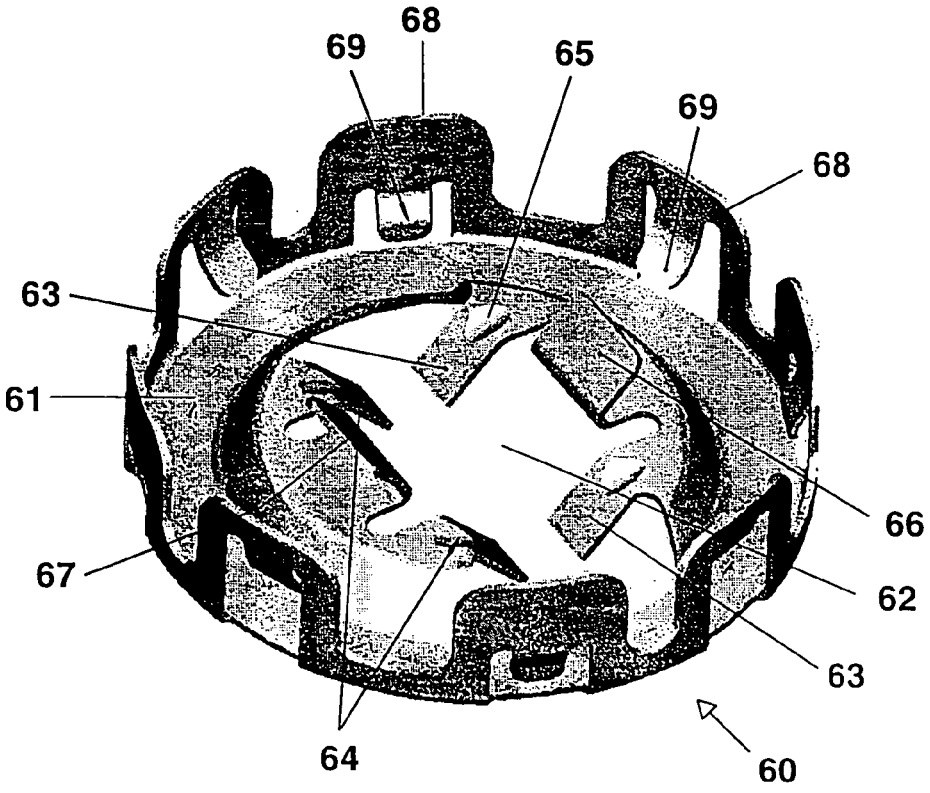
Figure 15:
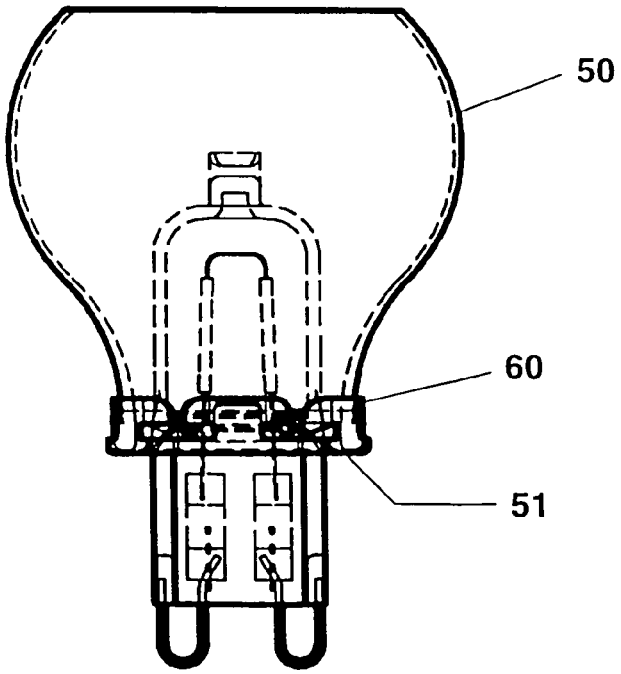
Figure 16:
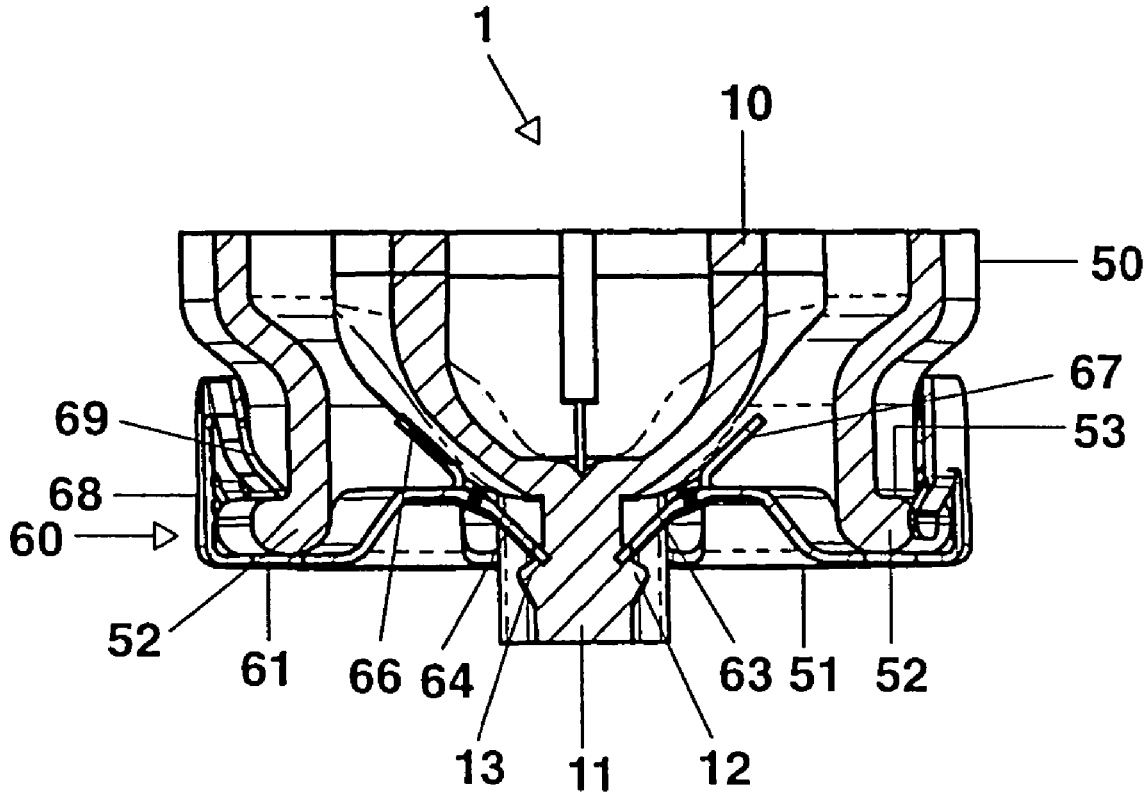

The invention will be explained in more detail below with reference to preferred exemplary embodiments. In the drawings:

FIG. 1 shows a partially sectioned illustration of a side view of the illumination unit according to the first exemplary embodiment of the invention, FIG. 2 shows a partially sectioned illustration of a side view, turned through 90 degrees with respect to FIG. 1, of the illumination unit depicted in FIG. 1, FIG. 3 shows a side view of the lamp of the illumination unit depicted in FIG. 1, FIG. 4 shows a plan view of the fastening clip of the illumination unit depicted in FIG. 1, FIG. 5 shows a side view along the axis A of the fastening clip depicted in FIG. 4, FIG. 6 shows a side view along the axis B of the fastening clip depicted in FIG. 4, FIG. 7 shows a partially sectioned illustration of a side view of the illumination unit according to the second exemplary embodiment of the invention, FIG. 8 shows a schematic of a partially sectioned side view of an outer bulb of the illumination unit according to the third exemplary embodiment of the invention, FIG. 9 shows a schematic of a plan view of the fastening clip according to the third exemplary embodiment of the invention, FIG. 10 shows a side view of the fastening clip depicted in FIG. 9, FIG. 11 shows a partially sectioned illustration of a side view of the illumination unit according to the third exemplary embodiment, FIG. 12 shows a partially sectioned illustration of a side view of the illumination unit according to the third exemplary embodiment in a position turned through an angle of 90 degrees with respect to FIG. 11, FIG. 13 shows a partially sectioned illustration of a side view of a fourth exemplary embodiment of the invention, FIG. 14 shows an isometric illustration of the fastening clip according to a fifth exemplary embodiment of the invention, FIG. 15 shows a side view of an illumination unit having the fastening clip depicted in FIG. 14, and FIG. 16 shows a cross section through the illumination unit depicted in FIG. 15, in the region of the fastening clip.

V. BEST MODE FOR CARRYING OUT THE INVENTION

The illumination unit depicted in FIGS. 1 to 6 according to the first exemplary embodiment of the invention comprises a high-voltage halogen incandescent lamp 1 which can be operated, without a voltage transformer, from the AC mains voltage and has an electrical power consumption of approximately 40 watt, a parabolic reflector 2, and a fastening clip 3 for fastening the reflector 2 to the lamp 1.

Details of the lamp 1 are depicted in FIG. 3. The lamp 1 has a quartz glass lamp vessel 10 which is sealed in a gas-tight manner and is provided at one end with a glass base 11, in particular a standardized G9 base. Two U-shaped electrical contacts 5, 6 of the lamp 1, which are connected to an incandescent filament 9 arranged within the lamp vessel 10 via in each case one molybdenum foil seal 7, 8 embedded in the glass base 11, protrude from the glass base 11. The glass base 11 which is in the form of a pinch seal is, in a spatial direction perpendicular to the longitudinal extent of the lamp 1, not as thick or as wide as the region of the lamp vessel 10 surrounding the incandescent filament 9. This is shown in the side view in FIG. 2. The lamp vessel 10 has, on the end of the glass base 11 facing the incandescent filament 9 and on the mutually opposite, broader sides of the lamp vessel 10, in each case two first depressions 12, 13 which act as support surfaces for in each case one resiliently formed tab 31, 32 of the fastening clip 3. In particular, the tabs 31, 32 are supported on the edges of the first support surfaces 12, 13. In addition, the lamp vessel 10 has, in the transition region from the glass base 11 to the widened lamp vessel region surrounding the incandescent filament 9, in each case two second depressions 14, 15, which act as support surfaces for the reflector 2, on mutually opposite sides of the lamp vessel 10. The first 12, 13 and second support surfaces 14, 15 are all located in a relatively narrow region of the surface of the lamp vessel 10 which is located between the molybdenum foil seals 7, 8 and the incandescent filament 9, in order, on the one hand, not to impair the light emission from the incandescent filament 9 and, on the other hand, to ensure that the lamp holder has free access to the glass base 11.

The reflector 2 is made of glass or plastic and is provided on its inner side with an interference filter coating 21 which reflects light and is permeable to infrared radiation. The light output opening in the reflector is covered by a transparent glass or plastic disk 4 which is impermeable to ultraviolet radiation. In the vertex region, the reflector 2 has an aperture 22, the rim of which is rectangular and the dimensions of which are matched to the dimensions of the glass base 11 of the lamp 1. The rim of the aperture 22 bears against the second support surfaces 14, 15 of the lamp vessel 10.

The reflector 2 is fastened to the lamp vessel with the aid of the fastening clip 3 which is depicted in FIGS. 4 to 6. The fastening clip 3 is made of resilient sheet steel and is in the form of a disk. It has the outer contour of a cross and a central aperture 30 matched to the dimensions of the glass base 11. In each case, two resiliently formed tabs 31, 32 are integrally formed on the rectangular rim of the aperture 30 along two opposite edges. The fastening clip 3 bears against the outer side of the reflector 2 in the vertex region of the latter, the resiliently formed tabs 31, 32 of the fastening clip 3 being supported in the first depressions 12, 13 or on the edges of the first support surfaces 12, 13.

In order to fit the reflector 2 to the lamp 1, the reflector 2 is pushed onto the glass base 11 until the rim of the aperture 22 rests on the second support surfaces 14, 15 molded in the surface of the lamp vessel 10, the edges of these hollowed-out support surfaces 14, 15 acting as a stop for the reflector 2. The fastening clip 3 is then pushed onto the glass base 11 until it bears against the outer side of the reflector 2 and the tabs 31, 32 engage in the hollowed-out, first support surfaces 12, 13 of the lamp vessel 10 which are molded on the lamp vessel 10. In this case, the resiliently formed tabs 31, 32 bear against the lamp vessel 10 with a press fit and the edges of the first support surfaces 12, 13 each form a stop for these tabs 31, 32 behind which they latch in. The reflector 2 and the fastening clip 3 are thereby fixed to the lamp vessel 10 with a clamping fit between the first 12, 13 and second support surfaces 14, 15. The tabs 31, 32 extend perpendicular to the longitudinal extent of the lamp 1 and their spring action is thus effective both in the longitudinal extent of the lamp 1 for producing the abovementioned clamping fit, and transversely to the longitudinal extent of the lamp 1 against the glass base 11.

The spacing between the vertex of the reflector 2 and the end of the glass base 11, from which the electrical contacts 5, 6 protrude, is 12 mm.

FIG. 7 depicts the illumination unit according to the second exemplary embodiment. The only difference between this illumination unit and that in the first exemplary embodiment is the fastening element 3'. The reflector 2 and the lamp 1 are of identical design in both exemplary embodiments and are therefore given the same reference numerals in FIG. 7. The fastening element 3' is in the form of a metallic clip which surrounds the glass base 11. The clip 3' has two pairs of resiliently formed first tabs 31', 32' which bear against the lamp vessel 10 in the hollowed-out first support surfaces 12, 13 and latch in behind there. The individual tabs of a first pair 31' or 32' act on mutually opposite sides of the lamp vessel 10 such that the lamp vessel 10 is arranged with a clamping fit between the tab pairs 31', 32'. In addition, the clip 3' is provided with two pairs of resiliently formed second tabs 33', 34' which reach through the aperture 22 in the reflector 2 and latch behind on that edge of the reflector 2 which is formed by the rim of the aperture 22.

In order to fit the reflector 2 to the lamp 1, first the clip 3' is fastened to the lamp vessel 10 by the clip 3' being pushed onto the glass base 11 until it adjoins the widened transition region to the part of the lamp vessel 10 which surrounds the incandescent filament 9. The first tabs 31', 32' in this case latch into the hollowed-out support surfaces 12, 13. Then, the lamp 1 with the clip 3' fixed thereto is inserted into the aperture 22 in the reflector 2 via the light output opening in the reflector 2 such that the glass base 11 protrudes from the reflector 2 through the aperture 22. In this case, the second tabs 33', 34' are also pushed through the aperture 22 so that they engage through the aperture 22 from inside to outside and their free end in the form of a hook latches behind on that edge of the reflector 2 which is formed by the rim of the aperture 22 in the reflector 2.

FIGS. 8 to 12 show the illumination unit according to the third exemplary embodiment of the invention. This illumination unit has, instead of a reflector 2, an outer bulb 2" as the envelope. The outer bulb 2" is made of transparent glass and has an approximately spherical shape. In addition, the outer bulb 2" has an aperture 22" having a circular rim 23". The circular rim 23" is provided on its outer side with a recess or groove 24" running round in annular fashion. The internal diameter of the aperture 22" is greater than the dimensions of the lamp 1 transversely to its longitudinal axis such that the lamp 1 can be inserted into the outer bulb 2" through the aperture 22". The outer bulb 2" is fixed to the lamp vessel 10 by means of the fastening clip 3" (depicted in FIGS. 9 and 10) produced from resilient sheet steel. The metallic fastening clip 3" is annular and has a channel 38" running round it in annular fashion for accommodating the rim 23" of the outer bulb 2". The annular metallic fastening clip 3" has a central aperture 30" for the glass base 11 of the lamp vessel 10 of the lamp 1. The shape and the dimensions of the central aperture 30" are matched to the form and the cross section of the glass base 11. Two pairs of mutually opposite resiliently formed first tabs 31", 32" are integrally formed on the rim of the aperture 30". The tabs 31" and 32", respectively, of a pair are supported in each case in the first depressions 12 and 13, respectively, on mutually opposite sides of the lamp vessel 10 depicted in FIG. 3 such that the lamp vessel 10 and the glass base 11, respectively, are arranged with a clamping fit between the first tabs 31" and 32", respectively, of in each case one pair of tabs, as is illustrated schematically in FIG. 12. The first tabs 31", 32" form, with the edges of the first depressions 12, 13 in the surface of the lamp vessel 10, a first latching connection. Two further tabs 36", 37", which are integrally formed on the fastening clip 3" and which are supported on the region of the lamp vessel 10 which is adjacent to the glass base 11 and is wider than the glass base 11, act as opposing bearings for the first tabs 31", 32". The interaction of the spring forces of the first tabs 31", 32" and the further tabs 36", 37" fixes the fastening clip 3" to the lamp vessel 10 in the longitudinal direction of the lamp 1. Three second tabs 33", 34", 35", which are stamped out from the material of the channel wall and whose free ends protrude into the channel 38", are integrally formed on the wall of the channel 38", equidistantly along its circumference. The second tabs 33", 34", 35" produce a second latching connection for fixing the fastening clip 3" to the outer bulb 2". They are latched in on the recess 24" on the rim 23" of the aperture 22" in the outer bulb 2".

In order to fit the outer bulb 2" to the lamp 1, first the fastening clip 3" is pushed onto the glass base 11 of the lamp 1 until the first tabs 31", 32" are latched into the hollowed-out support surfaces 12, 13 of the lamp vessel 10 and are supported on the edges of said support surfaces. The further tabs 36", 37" bear in a resilient manner against the region of the lamp vessel 10 which is wider than the glass base 11, such that the fastening clip 3" is fixed to the lamp vessel 10 with a clamping fit by means of the first tabs 31", 32" and the further tabs 36", 37" as well as by their interaction with the surface of the lamp vessel 10 in the longitudinal direction of the lamp 1. Then, the outer bulb 2" is turned back over the lamp 1 such that the rim 23" of the aperture 22" in the outer bulb 2" is arranged in the channel 38" of the fastening clip 3". In this case, the second tabs 33", 34", 35" of the fastening clip 3" latch in on the recess 24" on the outer side of the rim 23" of the aperture 22". In the illustrations in FIGS. 11 and 12, some parts of the fastening clip 3" which cannot generally be seen in these illustrations are drawn with dashed lines in order to show their interaction with other parts of the illumination unit. The end of the glass base 11 has a spacing of at least 12 mm from the fastening clip 3".

According to the fourth exemplary embodiment of the invention shown schematically in FIG. 13, a ceramic fastening ring 3'" is used which is connected to the lamp vessel 10 and to the outer bulb 2" using bonding agent. The fastening ring 3'" is designed as a pot in the form of a circular cylinder, that is to say it has a side wall **3*a* and a bottom 3***b* having a central aperture in the bottom 3*b*, the form and dimensions of the aperture being matched to the form and dimensions of the glass base 11 transversely with respect to the longitudinal axis of the lamp 1. The internal diameter of the pot 3''' in the form of a circular cylinder is matched to the external diameter of the rim 23" of the aperture 22" in the outer bulb 2". Bonding agent 39 is arranged on the bottom of the fastening ring 3'''. The fastening ring 3''' is pushed onto the glass base 11 until its bottom 3*b* rests on the region of the lamp vessel 10 which is wider than the glass base 11. The outer bulb 2" is inserted into the pot-like fastening ring 3'''. Once the fastening ring 3''' has been fitted to the lamp 1 and the outer bulb 2" to the fastening ring 3''', the bonding agent 39 is both between the rim 23" of the outer bulb 2" and the side wall 3*a* and the bottom 3*b* of the fastening ring 3''' and also between the lamp vessel 10 and the bottom 3*b* of the fastening ring 3'''. Once the bonding agent 39 has cured, the lamp 1 and the outer bulb 2" are bonded into the fastening ring 3'''. The glass base 11 protrudes at least 12 mm from the fastening ring 3'''. The bonding agent 39 need not cover the entire bottom 3*b* of the fastening ring 3'''. It is sufficient to provide a ring of bonding agent 39 along the inner side of the side wall 3*a* and also to arrange bonding agent 39 along the rim of the aperture in the bottom 3*b* of the fastening ring 3'''. In addition, a groove or a depression may also be provided in the bottom 3*b* on the rim of the central aperture in the fastening ring 3''' for accommodating the bonding agent 39. This prevents the foamed bonding agent 39 from covering excessively large regions on the lamp vessel 10 and the light emission from being impaired.

FIGS. 14 to 16 show the illumination unit according to the fifth exemplary embodiment of the invention. This illumination unit has an outer bulb 50 in the form of a bell as the envelope. The outer bulb 50 is made of transparent glass or a translucent ceramic. It has an aperture 51 having a circular rim 52. The circular rim 52 is provided on its outer side with a recess or groove 53 running round in annular fashion. The internal diameter of the aperture 51 is larger than the dimensions of the lamp 1 transversely with respect to its longitudinal axis such that the lamp 1 can be inserted into the outer bulb 50 through the aperture 51. The outer bulb 50 is fixed to the lamp vessel 10 by means of the fastening clip 60 (depicted in FIG. 14) produced from resilient sheet steel. The metallic fastening clip 60 is annular and has a channel 61 running round in annular fashion for accommodating the rim 52 of the outer bulb 50. The annular, metallic fastening clip 60 has a central aperture 62 for the glass base 11 of the lamp vessel 10 of the lamp 1. The shape and the dimensions of the central aperture 62 are matched to the form and the cross section of the glass base 11. Two pairs of mutually opposite, resiliently formed first tabs 63, 64 are integrally formed on the rim of the aperture 62. The tabs 63 and 64, respectively, of a pair are supported in each case in the first depressions 12 and 13, respectively, on mutually opposite sides of the lamp vessel 10 depicted in FIG. 3 such that the lamp vessel 10 and the glass base 11, respectively, are arranged with a clamping fit between the first tabs 63 and 64, respectively, of in each case one pair of tabs, as is shown schematically in FIG. 16. The first tabs 63, 64 form a first latching connection with the edges of the first depressions 12, 13 in the surface of the lamp vessel 10. In order to increase their mechanical robustness, the first tabs 63, 64 are each provided with a bead 65. Two further tabs 66, 67, which are integrally formed on the fastening clip 60 and are supported on the region of the lamp vessel 10 which is adjacent to the glass base 11 and is wider than the glass base 11, act as opposing bearings for the first tabs 63, 64. The interaction of the spring forces of the first tabs 63, 64 and the further tabs 66, 67 fixes the fastening clip 60 to the lamp vessel 10 in the longitudinal direction of the lamp 1. Eight webs 68, which each extend perpendicular to the bottom of the channel 61, are arranged on the outer wall of the channel 61 along the circumference of the fastening clip 60. The spacing between the webs 68 along the circumference of the fastening clip 60 is not equidistant but is selected such that the fastening clip 60 is accessible for gripping tools of an automatic installation apparatus. Each web 68 is provided with an integral second tab 69 which is stamped out of the material of the respective web 68 and whose free end protrudes into the channel 61. The second tabs 69 produce a second latching connection for fixing the fastening clip 60 to the outer bulb 50. They are latched in on the recess 53 on the rim 52 of the aperture 51 in the outer bulb 50.

The invention is not limited to the exemplary embodiments described in more detail above. For example, the fastening clip 3" according to the third exemplary embodiment is suitable not only for fixing an outer bulb but also for fastening a reflector to the lamp vessel 10. The second tabs 33", 34", 35" of the fastening clip 3" may also be replaced by a bonding agent which is arranged in the channel 38" in the fastening clip 3" in order to bond the outer bulb 2" in the channel 38". The second tabs 33", 34", 35" of the fastening clip 3", however, may also be replaced by a screw connection between the fastening clip 3" and the outer bulb 2" or the reflector. The outer bulb may be of any form. The outer bulb 2" may be made of glass or plastic and may have additives or coatings influencing the light color. In addition, part of the outer bulb 2" may also be silvered or matted on its inner or outer side. In this case, the outer bulb acts as a reflector. In addition, the outer bulb need not completely surround the lamp vessel but may also be in the form of a half-shell, for example, which surrounds the lamp vessel only within an angle of, for example, 180 degrees or less, for example 90 degrees. Instead of the reflector 2 in the form of a cold-light mirror, according to the first exemplary embodiment, the illumination unit according to the invention may also, in addition, have an aluminum reflector. The covering disk 4 is optional. The reflector or the abovementioned half-shell may be designed such that it can pivot or such that it can latch into different positions on the lamp vessel so that the light from the lamp can be deflected in different directions. The sealed-off end of the lamp vessel in the form of a base may also be in the form of a ceramic base instead of a glass base, for example.

What is claimed is:

1. An illumination unit comprising:

an electric lamp having a vessel with a vessel wall defining an enclosed volume, a light source positioned in the enclosed volume having two electric leads extending through a press sealed end of the vessel, the press sealed end and electric leads being configured as a base for axial insertion in a socket for mechanical and electrical coupling of the electric lamp;

an envelope having an envelope wall with a first side, and a second side, the envelope wall being formed with an envelope aperture extending from the first side to the second side, and having a circumferential lip extending around the envelope aperture adjacent the second side, the electric lamp being positioned in the envelope aperture with the press sealed end exposed adjacent the second side for axial coupling; and a fastener having the form of a plate with an internal wall defining a plate passage, the internal wall including a latch, the press sealed end being positioned in the plate passage, and securely coupled by the latch to the fastener to retain the vessel in relation to the fastener, the fastener further having a radial region extending transversely away from the press sealed end and adjacent the second side, and the fastener further having a peripheral coupling securely coupled to the envelope circumferentially along the lip to retain the envelope in relation to the fastener.

2. The illumination unit as claimed in claim 1, wherein the base is a glass base.

3. The illumination unit as claimed in claim 1, wherein the fastening means are in the form of a clip.

4. The illumination unit as claimed in claim 3, wherein the clip is made of sheet metal.

5. The illumination unit as claimed in claim 3, wherein the clip produces a clamping fit between the lamp vessel and the envelope.

6. The illumination unit as claim 3, wherein in the clip is connected to the lamp vessel by a first latching connection and to the envelope by a second latching connection.

7. The illumination unit as claimed in claim 6, wherein the first latching connection is formed by means of at least two resiliently formed first tabs which are integrally formed on the clip and are supported on support surfaces of the lamp vessel which are formed from the material of the lamp vessel, a region of the lamp vessel which is adjacent to the base and is wider than the base acting as the opposing bearing for the clip.

8. The illumination unit as claimed in claim 7, wherein the second latching connection is formed by means of at least two resiliently formed second tabs which are integrally formed on the clip and are latched behind on the rim of the aperture in the envelope.

9. The illumination unit as claimed in claim 7, wherein the clip has at least two resiliently formed third tabs which are supported on the region of the lamp vessel which is adjacent to the base and is wider than said base.

10. The illumination unit as claimed in claim 1, wherein the envelope is a reflector having a concave, light-reflecting reflective surface.

11. The illumination unit as claimed in claim 1, wherein the envelope is a transparent outer bulb which completely surrounds the rest of the lamp vessel apart from the base.

12. The illumination unit as claimed in claim 1, wherein the base is a G9 base and the minimum spacing between the envelope and the end of said base, from which the electrical contacts of the lamp protrude, is at least 12 millimeters.

* * * * *